United States Patent [19]

Malpas et al.

[11] Patent Number: 4,469,249

[45] Date of Patent: Sep. 4, 1984

[54] APPARATUS FOR DISPENSING LIQUIDS

[75] Inventors: Jon H. Malpas, Ocean Grove; Alan R. Calder, Melbourne, both of Australia

[73] Assignee: Diemoulders Proprietary Limited, Victoria, Australia

[21] Appl. No.: 323,665

[22] Filed: Nov. 20, 1981

[30] Foreign Application Priority Data

| | | | |
|---|---|---|---|
| Dec. 4, 1980 | [AU] | Australia | PE6755 |
| Jun. 3, 1981 | [AU] | Australia | PE9152 |
| Aug. 14, 1981 | [AU] | Australia | PF0260 |

[51] Int. Cl.[3] ..... B67B 7/24

[52] U.S. Cl. ..... 222/83; 222/553; 220/277; 220/278

[58] Field of Search ..... 222/81, 83, 83.5, 88, 222/89, 91, 153, 183, 553, 519, 105, 386; 137/318; 251/252; 220/277, 278

[56] References Cited

U.S. PATENT DOCUMENTS

| | | | |
|---|---|---|---|
| 2,698,113 | 12/1954 | Linton | 222/83 |
| 3,642,172 | 2/1972 | Malpas | 222/183 X |
| 4,322,018 | 3/1982 | Rutter | 222/83 |

FOREIGN PATENT DOCUMENTS

| | | | |
|---|---|---|---|
| 768271 | 2/1934 | France | 222/386 |
| 1163489 | 9/1969 | United Kingdom | 222/553 |

*Primary Examiner*—Joseph J. Rolla
*Assistant Examiner*—Kevin P. Shaver

[57] ABSTRACT

A dispenser tap has a body, a handle, and a probe mounted within the body. The probe is hollow and has a pointed inner end with openings allowing liquid to be dispensed. The body has a spigot-receiving part which has a bore passing through it and a seal at one end thereof. The probe has radially outwardly extending pins that fit into corresponding slots in the body. In use, turning the handle cammingly moves the probe to an extended non-return position such that the seal is pierced and rupturned. The pins within the slots prevent the probe from rotating during this operation.

16 Claims, 20 Drawing Figures

APPARATUS FOR DISPENSING LIQUIDS

This invention relates to improvements in apparatus for the dispensing of liquids and refers particularly, though not exclusively, to improvements in taps for use in conjunction with containers holding liquids in an airtight situation.

Over many years there has been developed an expertise in the area of wine casks of the type whereby the wine is held in a plastic bag and, as the wine is consumed, the bag collapses rather than allowing air or oxygen into the interior of the bag and thus to contaminate the wine. In this way, the life of the wine is considerably lengthened so that it can be consumed over a lengthy period of time such as, for example, six months. This requires that the bag itself be totally impervious to the ingress of oxygen. This has been made possible and thus the bag can prevent the ingress of oxygen for a very lengthy period of time such as, for example, twelve months. However, the particular dispensing means is normally a problem in that it is possible to have an ingress of oxygen through the material of the dispensing means and thus comtamination can occur.

With goods such as wine it is extremely important that the bag and the dispensing means be totally impervious to air so that the shelf life of the product would be at least twelve months.

Also, although this has been proved possible in the past, it has never proved possible with a dispensing means in the traditional form of a tap. Many devices are known but these have problems in that they must be held whilst dispensing and also are not in the traditional form of tap. A traditional form of tap has found great consumer acceptance.

It is therefore the principle of the present invention to provide apparatus for the dispensing of liquids which meets with consumer acceptance and provides for a longer shelf life of the product.

With the above and other objects in view, the present invention provides apparatus for dispensing liquids from a container, said apparatus including a body, a probe mounted within said body, and a handle, said probe being adapted to be moved by initiator means within said body upon or prior to the first operation of said apparatus axially inwardly so as to penetrate or rupture a frangible diaphragm at or adjacent the innermost end of said body.

Advantageously, the probe remains at the axially inwardly position after penetrating or rupturing the frangible diaphragm despite further and subsequent operation of the apparatus.

In order that the invention may be clearly understood and readily put into practical effect, there shall now be described by way of non-limitative example only preferred constructions of apparatus for dispensing liquids incorporating the preferred features of the present invention, the description being with reference to the accompanying illustrative drawings. In the drawings.

Figure 1:
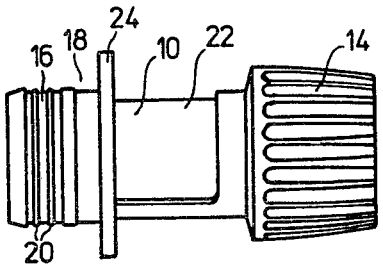
FIG. 1 is a side elevation of a first embodiment incorporating the preferred features of the present invention.
Figure 2:
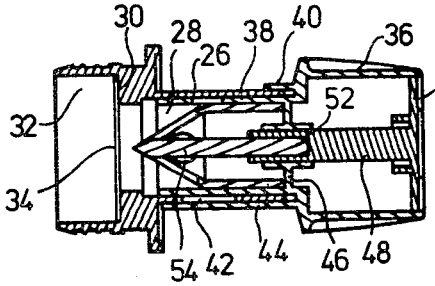
FIG. 2 is a vertical cross-sectional view along the longitudinal axis of the embodiment of FIG. 1.
Figure 3:
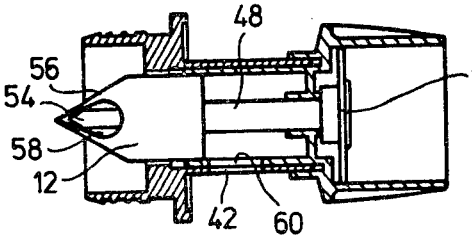
FIG. 3 is a partial vertical cross-sectional view of the embodiment of FIG. 1 but after the first operation of the apparatus.

To refer firstly to the first embodiment as illustrated in FIGS. 1 to 3, there is shown apparatus for dispensing of liquids and which has a body 10, a probe 12 mounted within the body 10, and a handle 14.

The body 10 has an inner part 16 adapted to be placed in a socket (not shown) so that the liquid contents of a container (not shown) can be dispensed. The inner part 16 has an outer wall 18 having a number of circumferential rings 20 which are designed to co-operate with suitable grooves in the socket to permanently and sealingly hold the apparatus therein in the manner of a snap fit. The outer end 22 of the inner part 16 has a radially outwardly extending flange 24.

Extending outwardly from the flange 24 and integral therewith is the outer or spigot receiving part 26 of body 10. As can be seen, the spigot receiving part 26, the flange 24 and the inner part 16 are an integral element comprising the body 10 which is made as an integral moulding.

The spigot receiving part 26 has a bore 28 passing therethrough. This is stepped at 30 so that the bore 32 through the main portion of the inner part 16 is of greater diameter. Furthermore, the spigot receiving part 26 has a hole 42 to enable the liquid to be dispensed, as will be understood from the following description.

At the step 30 there is provided a seal 34 closing the bore 28. The seal 34 may be made integrally with the remainder of the body 10 or may be subsequently attached by glueing, welding or otherwise. The seal 34 may be made of any suitable material as long as it is relatively impervious to air and can be readily broken or ruptured, as will be understood from the following description.

The handle 14 is of hollow construction and includes a gripping portion 36 adapted to be held by a user. Extending inwardly of the gripping portion 36 is a hollow spigot 38 passing within the spigot receiving portion 26 in the manner of a relatively tight fit. Also extending inwardly of the gripping portion 36 is a retaining flange 40 of lesser axial extent that the spigot. The retaining flange 40 retains the handle 14 in position relative to the body 10 and assists in the sealing action between the handle 14 and the body 10. The retaining flange 40 has a wiping portion 44 of greater axial length for a small part of its circumference. The wiping portion 44 is designed to cover and close hole 42 when the apparatus is in the OFF position. The spigot 38 has a hole 60 therethrough axially located with hole 42. Rotation of handle 14 to the ON position (FIG. 3) causes the two holes to be operatively aligned.

Extending across the interior of handle 14 is a bearing member 46 designed to receive rod 48 extending along the longitudinal axis of handle 14. At its outer end the rod 48 is attached to a plate member 50 which is a neat fit in the hollow interior of gripping portion 36 of handle 14. At its inner end, the rod 48 has a socket 52 for receiving the end of central shaft 54 of probe 12.

Probe 12 is of hollow construction and has a pointed inner end 56. The pointed inner end 56 has a number of openings 58 therethrough so that liquid to be dispensed can pass through the probe 12 and subsequently out of the apparatus via holes 42 and 60.

The operation of the apparatus is that when it is desired to remove or dispense the or some of the liquid from the container, it is first ensured that the handle 14 is in the OFF position (FIG. 2). In this position the holes 42 and 60 are not operatively aligned and, furthermore, the wiping portion also closes hole 42. The user then pushes on plate 50, using handle 14 as a finger grip. By pushing on plate 50, rod 48 acts to push the probe 12 axially inwardly. The pointed end 56 of probe 12 then pierces and ruptures the seal 34. Further pushing on plate 50 causes the probe 12 to pass through the seal 34 (FIG. 3) until plate 50 contacts bearing member 46, thus stopping any further movement.

At this stage the liquid can then pass through the openings 58 and probe 12 into the hollow interior of the apparatus. However, as the holes 42 and 60 are not operatively aligned, the liquid cannot be dispensed. The turning of handle 14 to the position of FIG. 3 brings the holes 42 and 60 into operative alignment as well as moving wiping portion 44 clear of hole 42. The liquid can then flow through the apparatus and be dispensed.

Rotation of handle 14 back to the OFF position will stop the flow of liquid.

The probe 12 remains in the position shown in FIG. 3 and has no effect on the future and further operation of the apparatus.

For further details as to the shape and configuration of the probe 12, wiping portion 44, and spigot 38 reference should be made to Australian Pat. Nos. 402,978 and 407,456.

Figure 4:
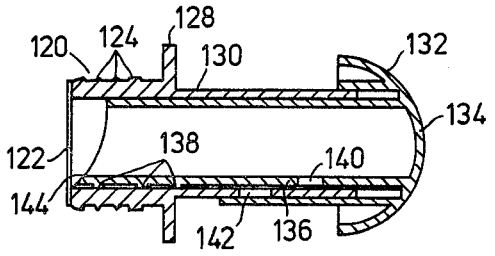
FIG. 4 is a vertical cross-sectional view along the longitudinal axis of a second embodiment.

To refer now to the embodiment of FIG. 4, there is shown apparatus having an inner part 120 having at its inner end an air impervious seal 122 so that the contents of the container cannot escape and nor can air enter the container. The outer wall of the inner part 120 has a number of circumferential rings 124 which are designed to co-operate with suitable grooves on the inner wall of socket (not shown) so that when the inner part 120 is placed in position it is permanently held there in the manner of a snap fit.

At its outer end the inner part 120 has a flange 128. Extending outwardly from the flange 128 and integral therewith is the spigot receiving portion 130. As can be seen, the spigot receiving portion 130 extends through the inner part 120 down to the seal 122. The entire part comprising the inner part 120, the rings 124, the flange 128 and the spigot receiving portion 130 is made as an integral moulding. The seal 122 may, possibly, be made in conjunction with that as part of the integral moulding or may be attached subsequently by any suitable means such as, for example, welding, adhesion or otherwise. The seal can be made of any suitable material, as can be the entire assembly, as long as it is air impervious and is easily penetrable.

There is also provided a spigot 132 of relatively known design or construction. It is particularly as is shown in our existing Australian Pat. Nos. 402,978 and 407,456. The spigot 132 has a handle portion 134 which is adapted to be held by a user to control the operation of the entire assembly. The spigot also has an entry portion 136 which is designed to pass within the spigot receiving portion 130 in the manner of a relatively tight fit. On the inner wall of the spigot receiving portion there are a number of axially displaced stops 138. These stops 138 co-operate with similar stops on the external surface of the spigot entry portion 136. Thus, in operation, the spigot is pushed axially inwardly until the similar stops on the entry portion 136 contact the first of the stops 138. In this condition the seal 122 is still intact and therefore wine cannot escape. Also, the exit hole 140 in the spigot entry portion 136 is not in alignment with the outlet hole 142 in the spigot receiving portion 130. Therefore no wine can escape. As the spigot can pass over the first stop during the assembly operation, the spigot cannot be removed and nor can it be accidentally moved axially inwardly. When it is desired to use the particular assembly the spigot is pushed axially inwardly until the leading portion 144 of the spigot entry portion 136 contacts and breaks the seal 122. In doing this, the stops on the spigot entry portion 136 pass over the second set of stops 138 on the spigot receiving portion 130 and come in contact with the innermost stop. In this operation, during the breaking of the seal 122, the holes 140 and 142 come into axial alignment. Therefore, the contents of the bag 118 can pass through the broken seal 122, the open interior of the spigot entry portion 136, and, once the holes are aligned, holes 140 and 142 are thus used. To control the flow of the contents the spigot handle 134 merely has to be rotated about its longitudinal axis. In this way, the holes 140 and 142 come into and out of alignment as is disclosed in the aforesaid Australian patent specifications. Also, the existing hygienic non-drip dispensing hole cover strip may be used as is disclosed in those particular specifications.

Figure 5:
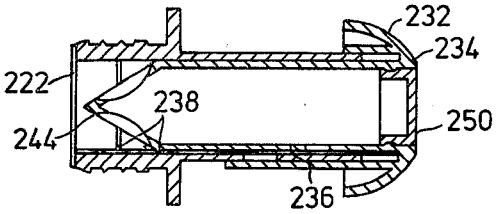
FIG. 5 is a vertical cross-sectional view along the longitudinal axis of a third embodiment.

To refer now to FIG. 5 there is shown a dispensing apparatus which, in effect, is identical to that of FIG. 4 except that the entry end 244 of the spigot entry portion 236 provides for the sealing of the seal 222 around the portion 244 to provide for a positive seal on that portion in the event of the rings 238 not sealing against the spigot entry portion 236. In this particular instance a plug 250 would be needed in the spigot handle 234 to close the hole necessary for the moulding of the spigot 232.

Figure 6:
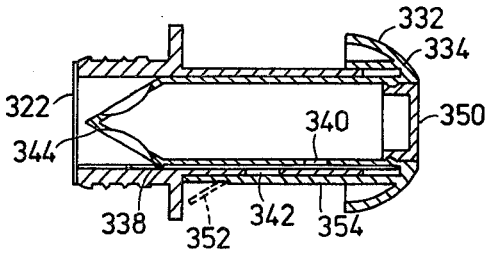
FIG. 6 is a vertical cross-sectional view along the longitudinal axis of a fourth embodiment.

FIG. 6 shows a form of the dispensing apparatus very similar to that of FIG. 5 except that the stops 338 are reduced in number to a single stop against which the piercing portion 344 rests. In this particular instance there is provided a tear-off safety flap 352 as an extension of the wiping portion 354 of the spigot. This wiping portion operates in the manner indicated in the aforementioned Australian specifications. In use, the tear-off safety flap 352 is removed and the entire spigot is pushed axially inwardly so that the portion 344 pierces and breaks the seal 322. The entire spigot is then returned axially until the piercing portion 344 passes back over the stop 338 and thus brings the holes 340 and 342 into axial alignment and thus the tap can be operated in the normal manner by turning the spigot 332. This particular embodiment creates a tap of relatively short axial dimensions yet still provides for security in that the tear-off flap 352 would have to be removed before the seal 322 could be broken to allow wine to escape. Again, a plug 350 is necessary in the end of the spigot handle 334 to close the handle as a result of the core of the die during the manufacturing operation.

Figure 7:
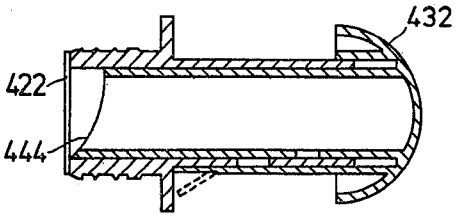
FIG. 7 is a vertical cross-sectional view along the longitudinal axis of a fifth embodiment.

The embodiment of FIG. 7 is identical to that of FIG. 6 except that the piercing portion 444 is of the same construction as the piercing portion 144 of FIG. 4. For this form of construction it is necessary to push the spigot 432 axially inwardly so that the portion 444 contacts the seal 422 and rotation of the spigot 432 causes the portion 444 to cut the seal 422. Axial outward movement of the spigot 432 would operate in the same manner as the spigot of FIG. 6.

Figure 8:
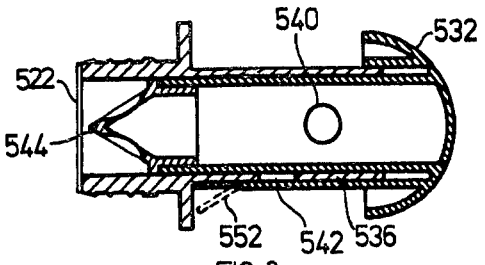
FIG. 8 is a vertical cross-sectional view along the longitudinal axis of a sixth embodiment.

FIG. 8 shows a combination; of the embodiments of FIGS. 4 and 6. As can be seen, it incorporates the tear-off safety flap 552 in the same manner as FIG. 6. However, it is to be noted that the two holes 542 and 540 are not in alignment in the unpierced position. Therefore, the piercing portion 544 is pushed through the seal 522 upon axial inward movement of the spigot 532 so that the two holes 540 and 542 are in a common plane after the piercing. At that stage, it only requires rotation of the spigot 532 about its axis to axially align the holes to cause the contents of the container to be able to be removed.

In this particular embodiment the piercing portion 544 is made as a separate piece from the spigot entry portion 536. This is done due to the necessity of manufacturing operations in order to make the remainder of the spigot 532 as a single piece. Also, once the piercing portion 544 has pushed through the seal 522 it will remain in that position.

Figure 9:
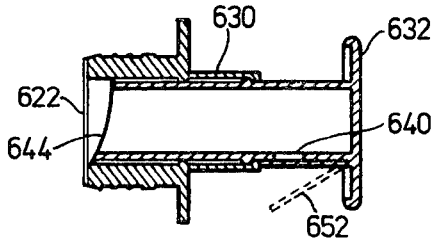
FIG. 9 is a vertical cross-sectional view along the longitudinal axis of a seventh embodiment.

FIG. 9 shows an embodiment similar to that of FIG. 6 in that a tear-off safety flap 652 is provided. However, in this particular case, the spigot receiving portion 630 is of shortened axial length so that once the safety flap 652 has been removed the hole 640 connects directly to the atmosphere enabling the contents to be later removed by the operation of the spigot 632 in the normal manner. However, the seal 622 is still intact. Therefore, the entire spigot 632 is moved axially inwardly so that the piercing portion 644 breaks the seal. At this particular stage the hole 640 is in connection with the spigot receiving portion 630 and therefore the contents cannot be removed. To enable the contents to be removed the spigot 632 is moved axially outwardly so that the contents will then pass through the hole 640 and be used by the consumer. When it is desired to cease the flow, the spigot 632 is moved axially inwardly. Therefore, this provides a push-pull operation so that the contents of the container can be removed quite easily. This particular embodiment provides for relatively simple construction, manufacture, and assembly. It also provides for very easy use.

Figure 10:
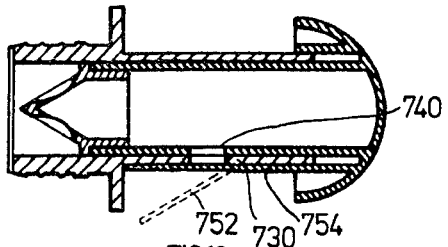
FIG. 10 is a vertical cross-sectional view along the longitudinal axis of an eighth embodiment.

The embodiment of FIG. 10 is very similar to that of FIG. 9 except that the tear-off flap 752 is made as an extension of the hygienic cover or non-drip strip 754 which operates in conjunction with the spigot receiving portion 730 in the manner as described in the earlier-mentioned Australian patent specifications. In this particular way the opening 740 is kept clean and there can be no residual drip of the contents falling from the apparatus after the flow of the liquid has ceased.

Figure 11:
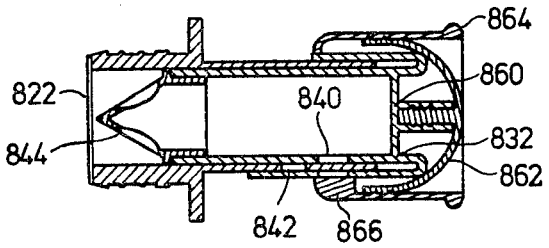
FIG. 11 is a vertical cross-sectional view along the longitudinal axis of a ninth embodiment.

The embodiment of FIG. 11 is similar to a combination of the embodiments of FIGS. 8 and 10. The physical construction is similar to that of FIG. 8 except that it is a push-pull operation for the control of the dispensing.

The particular spigot is extremely similar to that of FIG. 8 in that alignment of the holes 840 and 842 is necessary to enable the liquid to be dispensed. The initial operation is the axial inward movement of the spigot 832 to enable the piercing portion 844 to break the seal 822. At this stage a retaining member 860 attached to the spigot 832 moves with the spigot as part of the axial movement. To this retaining member 860 is attached to push bulb 862. The push bulb 862 is also attached to an outer body 864. During the axial inward movement the retaining member 860 pulls on the push bulb 862 so that it is placed under stress. When the holes 840 and 842 are in alignment and the seal 822 has been broken the contents of the container can flow through the holes 840 and 842. Once pressure on the spigot is released the stresses within the push bulb 862 cause it to pull the entire spigot 832 back to its original position as shown. It is to be noted that the outer body 864 does not move with the spigot as is clearly illustrated by the slight slot 866 in the spigot to allow it to pass through the outer body 864. This particular embodiment therefore provides for totally automatic operation on a push basis. All the user has to do with the particular apparatus is to initially push it to break the seal 822 and it will automatically return to the "OFF" position. Further pushing in subsequent operations will enable the liquids to be removed. If necessary, a tear-off safety flap may also be provided as an extension of part 842 so that the device can not be accidentally operated prior to its initial removal.

Figure 12:
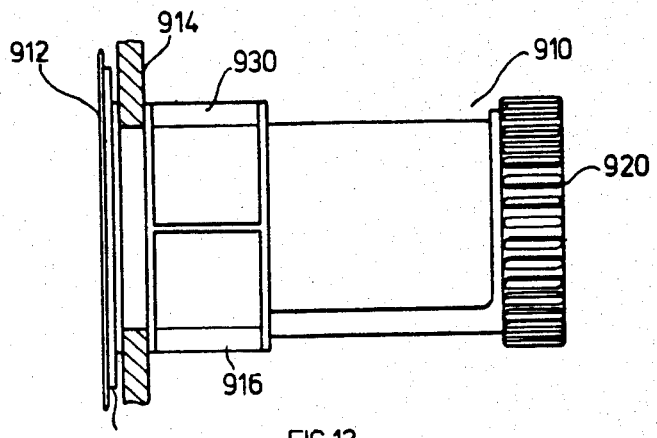
FIG. 12 is a side elevation of a tenth embodiment incorporating preferred features of the present invention.
Figure 13:
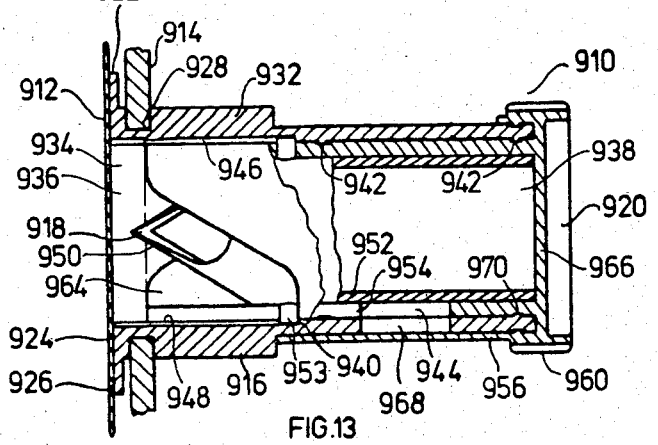
FIG. 13 is a partial vertical cross-sectional view in partial breakaway of the embodiment of FIG. 12.
Figure 14:
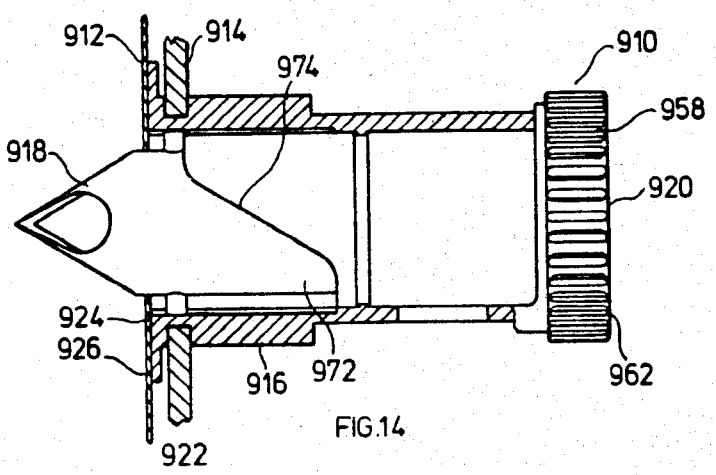
FIG. 14 is a partial vertical cross-sectional view of the embodiment of FIG. 12 after the first operation of the apparatus.

To refer to FIGS. 12 to 14, there is shown a dispensing tap 910 which is to enable the dispensing of the contents of a flexible bag 912 held within a container 914. The tap 910 has three components—a socket 916, a probe 918 and a handle 920.

The socket 916 is approximately cylindrical in shape and has an inner flange 922 of substantially increased radius. The flange 922 is adapted to be secured to the bag 912 by annular seals at 924 and 926. Adjacent the flange 922 is a portion 928 of reduced radius. This portion 928 has flats 930 to enable the tap 910 to be held in an appropriate opening in the container 914. Adjacent the portion 928 is a hold portion 932 of increased radius. This portion 932 is adapted to be held by user whilst the tap 910 is being used as well as retaining the tap 910 in position relative to the container 914.

The socket 916 has a central bore 934 extending for its entire length. The inner end portion 936 of the bore 934 has two opposed slots 946 extending longitudinally. Either or both of the slots 946 has a "saw-tooth" shaped projection 948 adjacent the inner end 936. The outer end of the slots 946 provides a step 940 at approximately the mid-point of the socket 916. Between the step 940 and the outer end 938 are a number of circumferential retaining seals 942 extending into the bore 934. Between the retaining seals 942 is an opening 944 to enable the contents of the bag 912 to be dispensed.

The probe 918 is, in use, located within the socket 916 in the bore 934. The probe 918 is hollow and has an entry portion 950 and a body portion 952. The entry portion 950 is substantially as for the tap described in Australian Pat. No. 407,456. The body 952 is a hollow open-ended cylinder of the same radius as the largest radius of the entry portion 950. Extending radially outwardly from the body 952 are two diametrally opposed pins 953. These pins 953 are, in use, located in the slots 946 to prevent the probe from turning about its longitudinal axis. Also, they co-operate with the step 940 and the "saw-tooth" projection 948 to limit the axial movement of the probe 918.

The handle 920 is located partly within the socket 916 and partly around the socket 916. The handle 920 comprises an inner body 954, an outer body 956, and a gripping portion 958. The gripping portion is approximately I-shaped in cross-section, with the outer surface 960 being provided with indentations 962 to assist the gripping action.

Extending inwardly from the gripping portion 958 is the inner body 954. The inner body 954 is hollow, cylindrically shaped, has an open inner end 964, and a closed outer end 966. Adjacent the outer end 966 is an opening 968 through which the contents of the bag 912 can be dispensed. The opening 968 is designed to coincide with the opening 944 in the socket 916. On either side of the opening there are circumferential grooves 970 in the outer surface of the inner body 954 which co-operate with the retaining seals 942 to seal against fluid flow and/or air flow as well as retaining the handle 920 against axial movement. The inner end of body 954 is provided with two right-angled triangular cutouts 972 spaced 180° apart. The hypotenuses 974 of the cutouts 972 are designed to co-operate with the pins 953 so that rotation of the handle 920 causes the hypotenuses 974 to push against the pins 953. Due to the angle of the hypotenuses 974 and the pins 953 being retained in slots 946, the probe 918 is forced axially inwardly until its entry portion 950 pierces and passes through the portion of bag 912 across the inner end 936 of bore 934. This enables the contents to be dispensed.

The outer body 956 of handle 920 is of sufficient longitudinal dimension to contact hold portion 932 but of reduced circumferential dimension. Also, its function is to cover opening 944 shortly after that opening has been closed by inner body 954 of handle 920. This creates a "wipe clean" action as is described in Australian Patent Specification No. 407,456. If desired, ON and OFF stops contactable by outer body 956 of handle 920 may be placed on the outer surface of socket 916 so that the limits of rotation of the handle 920 are accurately defined.

As can be seen, the pins 953 not only allow the inward movement of the probe 918, but also serve to define the axial limits of such movement. By contacting the steps 940, the pins 953 prevent outwards axial movement of the probe 918. Once the handle 920 has been turned for normal initiation of the penetrating action, the pins 953 pass over and then engage behind the saw tooth projection 948. This again prevents unwanted axial movement on the outwards direction. The probe 918 cannot move further inwardly as the pins 953 no longer contact the hypotenuses 974 and also the gripping action of the penetrated bag 912 around the entry portion 950 of probe 918. Thus once moved inwards, the probe 918 is permanently held in position.

Figure 15:
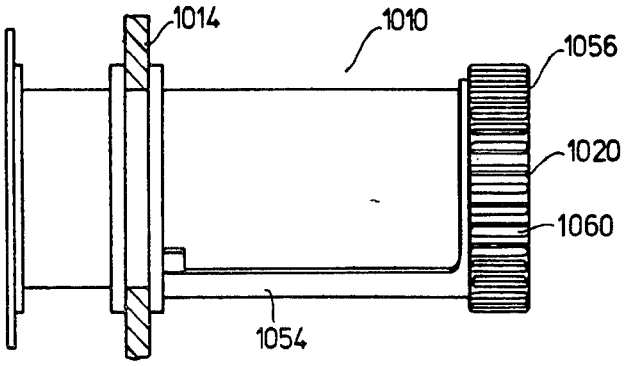
FIG. 15 is a side elevation of an eleventh embodiment incorporating preferred features of the present invention.
Figure 16:
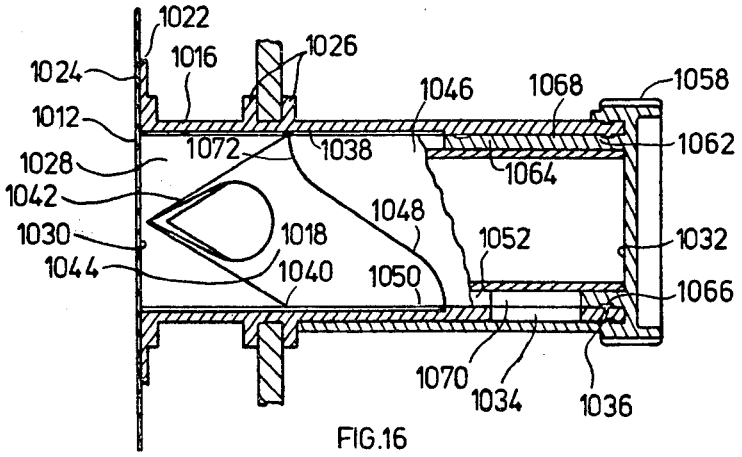
FIG. 16 is a partial vertical cross-sectional view in partial breakaway of the embodiment of FIG. 15.
Figure 18:
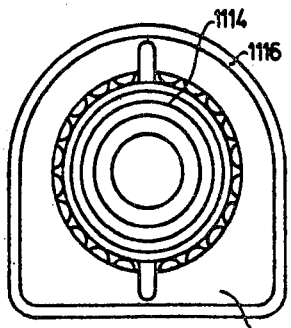
FIG. 18 is an end view of the embodiment of FIG. 17 in the direction of arrow 18 of FIG. 17.
Figure 17:
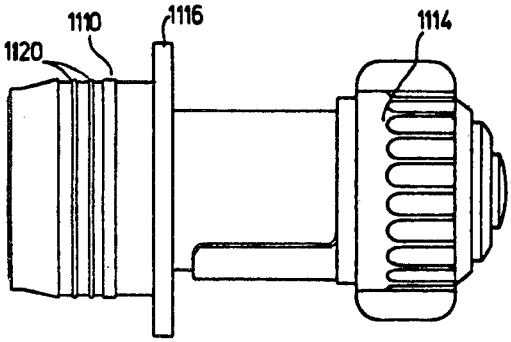
FIG. 17 is a side elevation of a twelfth embodiment incorporating preferred features of the present invention.
Figure 19:
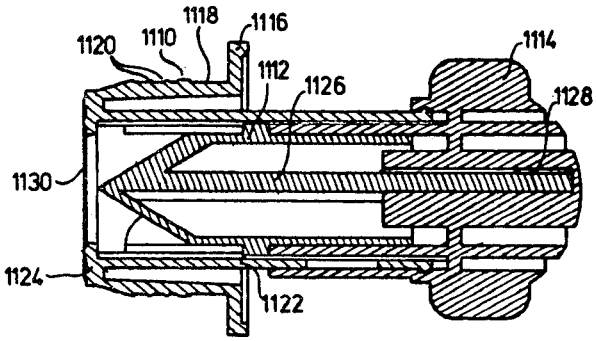
FIG. 19 is a vertical cross-sectional view along the longitudinal axis of the embodiment of FIG. 17.
Figure 20:
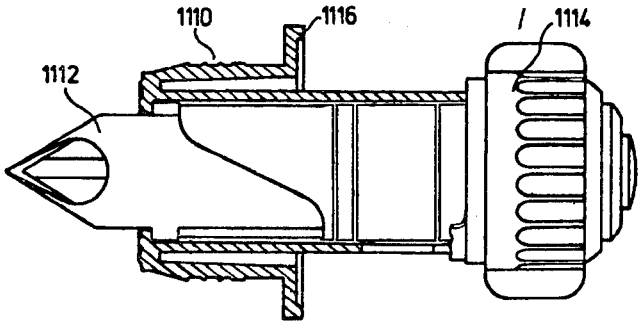
FIG. 20 is a partial vertical cross-sectional view of the embodiment of FIG. 17 after the first operation of the apparatus.

To refer now to FIGS. 15 and 16, there is shown a dispensing tap 1010 which is to enable the dispensing of the contents of a flexible bag 1012 held within a container 1014. The tap 1010 has three components—a socket 1016, a probe 1018 and a handle 1020.

The socket 1016 is approximately cylindrical in shape and has an inner flange 1022 of substantially increased radius. The flange 1022 is adapted to be secured to the bag 1012 at its inner surface 1024. Extending radially outwardly from the socket 1016 are two central flanges 1026 which are adapted to receive therebetween the container 1014 so as to retain the tap 1010 in position relative to the container.

The socket 1016 has a central bore 1028 extending for its entire length. At its inner end 1030 the bore 1028 is closed by the bag 1012. At its outer end 1032 the bore 1028 is closed by the handle 1020. Adjacent the outer end 1032 there is an opening 1034 through the socket 1016 to enable the contents of the bag 1012 to be dispensed. Extending radially inwardly into the bore 1028 on either side of opening 1034 are retaining seals 1036, the function of which will be described subsequently. Two opposed slots 1038 are provided and which extend from the bore 1028 into the socket 1016. The slots 1038 run from the inner end 1030 for over half the length of the socket 1016. Extending into the slots 1038 at approximately the mid-point of their length are two lugs 1040 which act as stops to prevent unwanted movement of the probe 1018.

The probe 1018 is, in use, located within the socket 1016 in the bore 1028. The probe 1018 is hollow and has an entry portion 1042 and a body 1044. The entry portion 1042 is substantially as for the tap described in the specification of Australian Pat. No. 407,456. The body 1044 is a hollow, open-ended cylinder of the same radius as the largest radius of the entry portion 1042. Surrounding the body 1044 is a helix body 1046. The helix body 1046 is of shorter axial length than body 1044 and has two opposed cut-outs 1048, each of which is shaped somewhat like a right-angled triangle. Between the two cut-outs 1048 are two opposed keys 1050 which extend for the full length of the helix body 1046. The keys 1050 are adapted to locate within the slots 1038 to prevent rotation of the probe 1018 about its longitudinal axis. The keys 1050 also co-operate with lugs 1040 and the outer end of slots 1038 to prevent unwanted axial movement of the probe 1018. This is done by the lugs 1040 preventing unwanted axially inwards movement when the probe 1018 is in the first position as illustrated whilst the ends of the slots 1038 prevent unwanted axially outwards movement. Once the probe 1018 has been moved inwardly (as will be described subsequently) the lugs 1040 prevent unwanted axially outwards movement.

The handle 1020 is located partly within the socket 1016 and partly around the socket 1016. The handle 1020 comprises an inner body 1052, an outer body 1054, and a gripping portion 1056. The gripping portion is approximately I-shaped in cross-section, with the outer surface 1058 being provided with indentations 1060 to assist the gripping action.

Extending inwardly from the gripping portion 1056 is the inner body 1052. The inner body 1052 comprises a first or body portion 1062 and a second or drive portion 1064. The body portion 1062 is hollow and cylindrical in shape. At each end thereof it has circumferential grooves 1066 in the outer surface 1068. The grooves 1066 co-operate with retaining seals 1036 to provide for fluid-tight seals and to retain the handle 1020 in the socket 1016. Between the grooves 1066 is an opening 1070 to enable the contents of the bag 1012 to be dispensed.

The second or drive portion 1064 of the inner body 1052 extends inwardly from the first portion 1062. The drive portion comprises two opposed elements 1072 each of which corresponds in size and shape to the cut-outs 1048. Also, the internal diameter of the inner body 1052 is the same as or slightly greater than the external diameter of the body 1046 of probe 1018. Thus, upon rotation of the handle 1020, the elements 1072 rotate. As the probe 1018 cannot rotate, the angle of cut-outs 1048 and the elements 1072 is such that the probe 1018 is moved axially inwardly until it pierces and penetrates the bag 1012. At that stage, the outer end of probe 1018 clears the opening 1070 so that, if openings 1070 and 1034 are aligned, the contents of the bag 1012 can be dispensed.

The outer body 1054 of handle 1020 is of sufficient longitudinal dimension to contact the outermost of the two central flanges 1026 but is of reduced circumferential dimension. The function of the outer body 1054 is to cover opening 1034 after it has been closed by inner body 1052 due to rotation of the handle 1020. This creates a "wipe clean" action as is described in Australian Patent Specification No. 407,456. If desired, ON and OFF stops contactable by the outer body 1054 of handle 1020 may be placed on the outer surface of socket 1016 so that the normal limits of rotation of handle 1020 are accurately defined.

To refer now to FIGS. 17 to 20, there is shown a dispensing tap which comprises three different parts—a socket 1110, a probe 1112 and a handle 1114.

The socket 1110 is approximately cylindrical in shape and is designed to be received in a receptor with a snap fit as per the other embodiments. With this in mind, the socket 1110 has an outer flange 1116 and an outer body 1118. The outer body 1118 has a number of external ribs 1120 designed to co-operate with and seal with the receptor when the two are engaged. The socket has an inner body 1122 which is integral with the outer body 1118 by means of an annular inner flange 1124. Extending across the opening of flange 1124 is a multi-ply heat sealed diaphragm 1130. The inner body 1122 extends longitudinally outwardly for a far greater axial distance than the outer body 1118.

Located within the inner body 1122 and co-operating therewith is the probe 1112. Attached to the end of inner body 1122 is the handle 1114, which also extends inside the inner body 1122. The operation of the probe 1112 and the handle 1114 and their working interrelationship is as described in the earlier embodiments and in particular FIGS. 12 to 14.

The principal difference in construction and operation is that the probe 1112 has an outwardly extending axial bar 1126 which is received in a socket 1128 in handle 1114. The bar is of non-circular cross-section and the socket 1128 is of complementary shape. Preferably, the bar 1126 and socket 1128 are both Y shaped in cross-section, although they could be square, rectangular, or any other non-circular shape. The socket 1128 has an axial extent greater than the axial movement of the probe 1112 when in operation and the bar 1126 extends into the socket 1128 for the full length of the socket 1128 when in the initial position shown. The bar 1126 can move axially within the socket 1128 but cannot rotate relative thereto.

When the dispensing tap is operated, the first rotation of the handle 1114 causes the probe 1112 to move axially inwardly to pierce the diaphragm 1130. This allows the contents of the container (not shown) to be dispensed. As the probe 1112 moves inwardly the bar 1126 moves along the socket 1128 but always remains at least in part within the socket 1128. Also, as the probe 1112 cannot rotate about its longitudinal axis the bar 1126 cannot rotate. Thus, as the socket 1128 and bar 1126 are of complementary shape the turning of the handle 1114 causes the socket 1128 to act on the bar 1126 to impart a twist or torsion thereto.

The bar 1126 is made of a relatively resilient material so that the imparting of the twist or torsion to the bar 1126 does not permanently deform the bar 1126 by the amount of the twist. That is, the bar 1126 has elastic memory.

When the handle 1114 is released, the twist or torsion imparted to bar 1126 is released and thus the bar 1126 acts on socket 1128 to force the handle 1114 to return to its original or OFF position. Preferably, limit stops are provided to locate the OFF position and to prevent excessive rotation of handle 1114.

As the bar 1126 can move axially within socket 1128, the return of handle 1114 to the OFF position under the action of bar 1126 does not cause probe 1112 to move and thus the probe 1112 maintains its position whereby the diaphragm is pierced.

Alternatively, the handle can have the torsion bar and the probe the socket. Another alternative would be for the torsion bar to be a discrete element and both the handle and the probe could have sockets. Other, similar variations are also possible such as the use of a spiral spring.

The particular seal or diaphragm as shown in all of the diagrams and described in the above description may be totally heat sealed to the socket or it may be lightly heat sealed or again a peelable sealed diaphragm may be used if this is desired. For all embodiments the particular seal may pass completely across the inner end of the socket or may merely seal across the spigot receiving portion of each particular embodiment.

Whilst there has been described in the foregoing description preferred constructions of improved apparatus for the dispensing of liquids incorporating the essential features of the present invention, it will be understood by those skilled in the art that various modifications or variations in details of design or construction may be made without departing from the essential nature of the invention as will be understood from the following claims.

We claim:

1. Apparatus for dispensing liquids from a container, said apparatus including a body, a probe mounted within said body, and a handle mounted at one end; said probe being adapted to be moved by initiator means within said body upon or prior to an initial dispensing operation of said apparatus to an extended non-returnable position whereby such probe movement penetrates or ruptures a frangible diaphragm at or adjacent the other end of said body, said probe having retaining means extending radially outwardly therefrom which are located in corresponding slots in said body so as to prevent rotation of said probe about its longitudinal axis when moved to said extended non-returnable position.

2. Apparatus as claimed in claim 1, wherein said body has an inner part and a spigot receiving part, said frangible diaphragm being across the innermost end of said inner part.

3. Apparatus as claimed in claim 1 wherein said probe remains at said axially inwardly position after penetrating or rupturing said frangible diaphragm despite further or subsequent operation of said apparatus.

4. Apparatus as claimed in claim 1 werein there is provided a resilient means operatively connected between said handle and said body so as to bias said handle to the OFF position.

5. Apparatus as claimed in claim 1 wherein said probe is in the form of a spigot located within a spigot receiving part of said body, said handle having a wiping portion extending axially along the outside of said spigot receiving part so as to close a first hole in said spigot receiving part when said apparatus is in a closed position.

6. Apparatus as claimed in claim 5, wherein said spigot has a second hole which is adapted to be operatively aligned with said first hole only when said apparatus is in an open position.

7. Apparatus as claimed in claim 5 wherein said initiator means is integral with said handle and comprises a hollow open-ended cylinder located within said spigot receiving part.

8. Apparatus as claimed in claim 1, wherein said initiator means has an inner end provided with a cam surface so as to act upon said probe to force said probe to said axially inwardly position on said initial dispensing operation of said apparatus.

9. Apparatus as claimed in claim 8, wherein said cam surface acts upon said retaining means of said probe.

10. Apparatus as claimed in claim 8, wherein said cam surface acts upon a corresponding cam surface on said probe.

11. Apparatus as claimed in claim 1, wherein said handle is of hollow construction and has a gripping portion adapted to be held by a user, a hollow spigot adapted to be received in a spigot receiving part of said body and a retaining flange.

12. Apparatus as claimed in claim 11, wherein said spigot has a first hole therethrough and said spigot receiving part has a second hole therethrough, said first hole and said second hole being operatively aligned only when said apparatus is in an open position, and said retaining flange has a wiping portion of extended axial length adapted to close said second hole when said apparatus is in a closed position.

13. Apparatus as claim in claim 11 wherein said initiator means is integral with said handle and comprises a hollow open-ended cylinder located within said spigot receiving part.

14. Apparatus as claimed in claim 13 wherein there is provided a resilient means operatively connecting said probe and said handle, said resilient means acting to bias said handle to the OFF position.

15. Apparatus as claimed in claim 14, wherein said resilient means is a torsion bar integral with said probe and being received in a socket in said handle.

16. Apparatus as claimed in claim 14, wherein said resilient means is a torsion bar integral with said handle and being received in a socket in said probe.

* * * * *

UNITED STATES PATENT AND TRADEMARK OFFICE

CERTIFICATE OF CORRECTION

PATENT NO. : 4,469,249

DATED : September 4, 1984

INVENTOR(S) : Jon Henry Malpas et al

It is certified that error appears in the above-identified patent and that said Letters Patent are hereby corrected as shown below:

Col. 11, line 13 change "werein" to --wherein--.

Signed and Sealed this

*Twenty-sixth* Day of *February 1985*

[SEAL]

*Attest:*

DONALD J. QUIGG

*Attesting Officer* *Acting Commissioner of Patents and Trademarks*